US011400009B2

(12) United States Patent
Mehndiratta et al.

(10) Patent No.: US 11,400,009 B2
(45) Date of Patent: Aug. 2, 2022

(54) EXOSKELETON DEVICE FOR UPPER LIMB REHABILITATION

(71) Applicant: Indian Institute of Technology Delhi, New Delhi (IN)

(72) Inventors: Amit Mehndiratta, New Delhi (IN); Neha Singh, New Delhi (IN); Sneh Anand, New Delhi (IN)

(73) Assignee: Indian Institute of Technology Delhi, New Delhi (IN)

( * ) Notice: Subject to any disclaimer, the term of this patent is extended or adjusted under 35 U.S.C. 154(b) by 181 days.

(21) Appl. No.: 15/733,028

(22) PCT Filed: Oct. 11, 2018

(86) PCT No.: PCT/IN2018/050649
§ 371 (c)(1),
(2) Date: Apr. 23, 2020

(87) PCT Pub. No.: WO2019/082199
PCT Pub. Date: May 2, 2019

(65) Prior Publication Data

US 2020/0261299 A1 Aug. 20, 2020

(30) Foreign Application Priority Data

Oct. 24, 2017 (IN) ..... 201711037641

(51) Int. Cl.
*A61H 1/02* (2006.01)

(52) U.S. Cl.
CPC ... *A61H 1/0288* (2013.01); *A61H 2201/0157* (2013.01); *A61H 2201/0176* (2013.01);
(Continued)

(58) Field of Classification Search
CPC ..... A61H 1/0285; A61H 1/0288; A61H 2205/065
See application file for complete search history.

(56) References Cited

U.S. PATENT DOCUMENTS 5,103,807 A * 4/1992 Makaran ..... A61H 1/0288 601/40
5,697,892 A * 12/1997 Torgerson ..... A61H 1/0288 601/40

(Continued)

FOREIGN PATENT DOCUMENTS

CN 103417360 A 12/2013
KR 101098565 B1 12/2011
WO WO-2019082199 A1 5/2019

OTHER PUBLICATIONS

"International Application No. PCT/IN2018/050649, International Search Report and Written Opinion dated Jan. 9, 2019", (dated Jan. 9, 2019), 9 pgs.

*Primary Examiner* — Michael J Tsai
(74) *Attorney, Agent, or Firm* — Schwegman Lundberg & Woessner, P.A.

(57) ABSTRACT

An exoskeleton device for rehabilitation of distal joints of an upper limb of a patient is described. The exoskeleton device includes a multi-bar linkage and a first platform to support fingers of the patient. The exoskeleton device includes a second platform to support a palm of the patient. The first platform and the second platform are coupled to the multi-bar linkage. The exoskeleton device also includes a transmission unit to drive the multi-bar linkage to move the first platform and the second platform to provide flexion and extension of the distal joints of the upper limb of the patient. In addition, the exoskeleton device includes an armrest and a fastening mechanism to fasten a forearm of the patient.

16 Claims, 7 Drawing Sheets

(52) U.S. Cl.
CPC .. *A61H 2201/1215* (2013.01); *A61H 2201/14* (2013.01); *A61H 2201/165* (2013.01); *A61H 2201/1638* (2013.01); *A61H 2201/501* (2013.01); *A61H 2201/5043* (2013.01); *A61H 2230/105* (2013.01); *A61H 2230/60* (2013.01)

(56) References Cited

U.S. PATENT DOCUMENTS

| | | | | |
|---|---|---|---|---|
| 5,912,658 | A * | 6/1999 | Bergamasco | B25J 13/02 345/156 |
| 7,410,338 | B2 | 8/2008 | Schiele et al. | |
| 2004/0243025 | A1* | 12/2004 | Peles | A61H 1/0277 601/5 |
| 2010/0204804 | A1 | 8/2010 | Garrec | |
| 2010/0305717 | A1* | 12/2010 | Tong | A63B 21/4021 623/64 |
| 2013/0030327 | A1 | 1/2013 | Zhang et al. | |
| 2013/0261514 | A1* | 10/2013 | Tsui | A61H 1/0288 601/40 |
| 2018/0177666 | A1* | 6/2018 | Tsui | A61F 5/013 |
| 2018/0185231 | A1* | 7/2018 | Huang | A61H 1/0288 |
| 2019/0029909 | A1* | 1/2019 | Perry | A61H 1/0288 |
| 2020/0360169 | A1* | 11/2020 | Kelly | A61F 5/013 |
| 2021/0369535 | A1* | 12/2021 | Ishimine | A61H 1/02 |

* cited by examiner

EXOSKELETON DEVICE FOR UPPER LIMB REHABILITATION

PRIORITY CLAIM TO RELATED APPLICATIONS

This application is a U.S. national stage filing under 35 U.S.C. § 371 from International Application No. PCT/IN2018/050649, filed on 11 Oct. 2018, and published as WO2019/082199 on 2 May 2019, which claims the benefit under 35 U.S.C. 119 to India Application No. 201711037641, filed on 24 Oct. 2017, the benefit of priority of each of which is claimed herein, and which applications and publication are hereby incorporated herein by reference in their entirety.

TECHNICAL FIELD

The present subject matter relates, in general, to upper limb rehabilitation and, in particular but not exclusively, to an exoskeleton device for upper limb rehabilitation.

BACKGROUND

Generally, after a stroke or a neurological injury, a patient often undergoes a prolonged rehabilitation process to recover some or all of the body functions damaged in the stroke or the neurological injury. Such rehabilitation may attempt to bring back damaged muscles or joints to normal functioning. In some cases, the damage to the body and/or brain is such that the patient has to be trained with the help of an external device.

BRIEF DESCRIPTION OF DRAWINGS

The following detailed description references the drawings, wherein.

DETAILED DESCRIPTION

Figure 1:
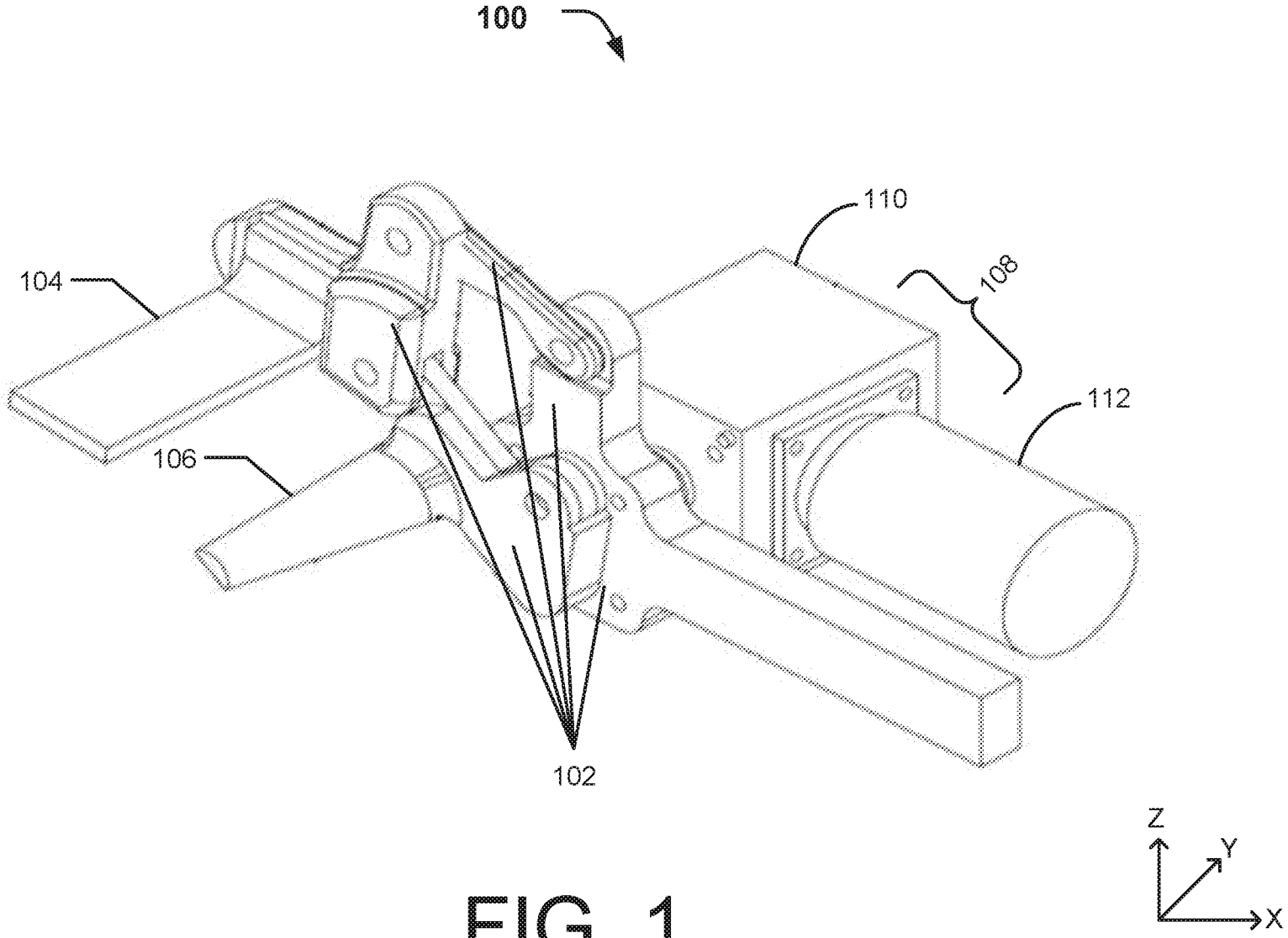
FIG. 1 illustrates a schematic of an exoskeleton device, according to an example implementation of the present subject matter.

Paralysis may be caused due to various neurological disorders such as stroke, brain injury, spinal cord injury, cerebral palsy, etc. or any neurological disease that may cause disabilities in the upper limb. Regaining functionalities in the upper limb, after paralysis, is often difficult as compared to functionalities of lower limb. Typically, physiotherapy is a widely accepted recovery and rehabilitation technique for upper-limb rehabilitation after stroke. However, physiotherapy consists of mostly passive exercises and is subjective for muscular recovery as it depends on experience of a physiotherapist. Moreover, physiotherapy does not provide any feedback of performance of the patients. Thereby, physiotherapy causes the patients to visit a hospital frequently.

In case of stroke, flexor muscles of distal joints, such as wrist joint are most affected. The distal joints help in performing day-to-day activities, such as grasping movement for eating, dressing, bathing, and the like. However, recovery of the upper limb starts from the proximal joints and progresses towards the distal joints. As a result, even when the recovery of stroke has completed in the proximal joints, the recovery in the distal joints takes time and compel the patients for regular hospital visits for the physiotherapy of the distal joints. Moreover, existing devices for rehabilitation of upper limbs are designed for proximal joints i.e. focus on shoulder joint and elbow joint.

Robotic assisted therapy is also used for rehabilitation over physiotherapy after stroke for better rehabilitation. The robotic assisted therapy involves robotic devices tailored for assisting different functions of the upper limb, precise repeatability, assisting therapeutic training, and assessment of performance of the patient's movements. However, the use of robotic devices for therapy has not gained popularity because of associated high cost, heaviness of the robotic device and portability issue.

Various implementations of the present subject matter describe an exoskeleton device with four-bar linkages to assist upper limb rehabilitation, particularly of the distal joints. For example, the distal joints may include a wrist joint and a meta-carpo-phallengial (MCP) joint. The exoskeleton device of the present subject matter is low-cost, light weight, and portable. Accordingly, the exoskeleton device may be used as a clinical set-up, a rehabilitation set-up, or as a home-based rehabilitation device.

In an implementation, the exoskeleton device of the present subject matter includes a multi-bar linkage, a first platform for supporting fingers of a patient, a second platform for supporting a palm of a patient, and a transmission unit. In an example, the first platform and the second platform are being coupled to the multi-bar linkage. The multi-bar linkage facilitates movement of the distal joints of the upper limb of the patient. For example, the multi-bar linkage allows flexion and extension of both wrist joint and fingers of the patient.

Further, the transmission unit drives the multi-bar linkage to move the first platform and the second platform from a first position to a second position. The movement of the multi-bar linkage with the first platform and the second platform provides flexion and extension of the distal joints of the upper limb of the patient. The exoskeleton device employs a plurality of electrodes attached to the upper limb of the patient to detect an activity performed by muscles of the upper limb when the patient puts in effort to move the distal joints.

As every stroke patient may have different capabilities, the patient defines various parameters associated with the movement of the distal joints of the upper limb, based on their physical condition. For example, the patient defines a first position of the distal joints, a second position of the distal joints, a time period of detecting activity of a forearm extensor, a speed of movement from the first position to the second position, and the like. Thereafter, the exoskeleton device is worn by the patient on his upper limb such that the fingers are rested on the first platform and the palm is rested on the second platform.

The transmission unit positions the upper limb of the patient in the first position. In the first position, an activity of the forearm extensor is detected by the plurality of electrodes. The activity is indicative of an effort put in by the patient to move the distal joints. Based on the parameters defined by the patient and upon detection of the activity of the forearm extensor muscle for a pre-defined time period, the exoskeleton device gets activated automatically. As a result of the activation, the exoskeleton device moves from the first position to the second position and back to the first position.

In an example, the exoskeleton device completes multiple cycles of the movement. For each cycle, the activity is detected from the forearm extensor and the exoskeleton device moves from the first position to the second position and back to the first position. The movement from the first position to the second position enables extension and flexion of the wrist joint and fingers of the patient. The movement from the second position back to the first position, enables flexion and extension of the wrist joint and fingers joint of the patient. The performance and results of performance of the patient is used as a feedback by the controller to modify the parameters associated with the movement of the distal joints of the upper limb.

Accordingly, the exoskeleton device focuses on movements of the distal joints and may work as a home-based therapy, thereby reducing visits to the hospitals. The exoskeleton device also provides ease in operation thereby can be operated by the patient itself. The exoskeleton device provides feedback of performance and results of performance of the patient to constantly encourage and engage the patient. In addition, the exoskeleton device is low cost and light weight, thus can be afforded by the patients suffering from complications of the upper limb.

The present subject matter is further described with reference to the accompanying figures. Wherever possible, the same reference numerals are used in the figures and the following description to refer to the same or similar parts. It should be noted that the description and figures merely illustrate principles of the present subject matter. It is thus understood that various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates a schematic of an exoskeleton device 100, according to an example implementation of the present subject matter. The exoskeleton device 100 includes a multi-bar linkage 102, a first platform 104 to support the fingers of the patient, a second platform 106 to support the palm of the patient, and a transmission unit 108 to drive the multi-bar linkage 102. The first platform 104 and the second platform 106 is coupled to the multi-bar linkage 102. The multi-bar linkage 102 includes a plurality of bars connected to each other to facilitate in movement of the distal joints along different degrees. In an example, all bars of the multi-bar linkage 102 are attached to each other by screws. The multi-bar linkage 102 enables in flexion and extension of the distal joints of the upper limb. Details pertaining to the multi-bar linkage 102 are provided in conjunction with FIG. 2.

In an implementation, the transmission unit 108 includes a gear box 110 and a motor 112 to drive the multi-bar linkage 102. In an example, the gear box 110 is a four-walled box, made up of Aluminum or any other light weight yet strong material. The selection of the material facilitates in maintaining a low weight of the exoskeleton device 100. The gear box 110 includes a gear assembly having a plurality of gears. In an example, the gears are of straight bevel type. Details pertaining to the gear assembly are provided in conjunction with FIG. 4.

Further, the motor 112 facilitates in motorizing the upper limb of the patient because of high torque demands to drive spastic hands of patients. In an example, a shaft (not shown) of the motor 112 is screwed with one bar from the multi-bar linkage 102. Further, in an example, the motor 112 has low rotations per minute (RPM) which were further reduced due to 2:1 gear ratio. The motor 112 provides high torque, such as 120 Kg-cm, which is further doubled by the 2:1 gear ratio and is therefore sufficient to drive the hands on maximum scale of spasticity. The motor 112 is light weight to maintain the low weight of the exoskeleton device 100. In an example, the transmission unit 108 is located at a wrist joint to enable the wrist joint to move from one position to another. The wrist joint is formed by the multi-bar linkage 102 and a bar for forearm attachment. To reduce friction in movement of the multi-bar linkage 102, the exoskeleton device 100 may include bearings between all joint structures.

In an implementation, the multi-bar linkage 102 and the motor 112 facilitates in the movement of the distal joints of the upper limb of the patient from an initial position to a final position and back to the initial position. The initial and the final positions of the distal joints are defined by the patient. In the present implementation, the exoskeleton device 100 may function in two different modes. For example, in the first mode, in the initial position, a wrist of the patient is flexed with fingers extended and in the final position the fingers are flexed with the wrist extended. In the second mode, in the initial position, the wrist of the patient is flexed with fingers extended and in the final position both the fingers and the wrist are extended.

The exoskeleton device 100, thereby facilitates in improving activities of daily living (ADL) of the patient by assisting in range of motion of wrist and the MCP joint. For example, the above-described movements of the distal joints help the patient in day-today activities, like wrist extension with grasping movement for eating, bathing, dressing, holding a mobile, door knob or a glass of water. In addition, the exoskeleton device 100 facilitates in reducing flexor hypertonia and spasticity of patients by repetitive training of wrist joint and the MCP joint in certain range and within a changeable period of time. In addition, the exoskeleton device 100 may be used to avoid disuse atrophy in patients of stroke, cerebral palsy, brain injury, spinal cord injury, etc., that may be caused by paralysis or disability of the upper limb. In addition, the exoskeleton device 100 provides enough torque to drive a patient's hand which has maximum spasticity on the spasticity scale.

Figure 2:
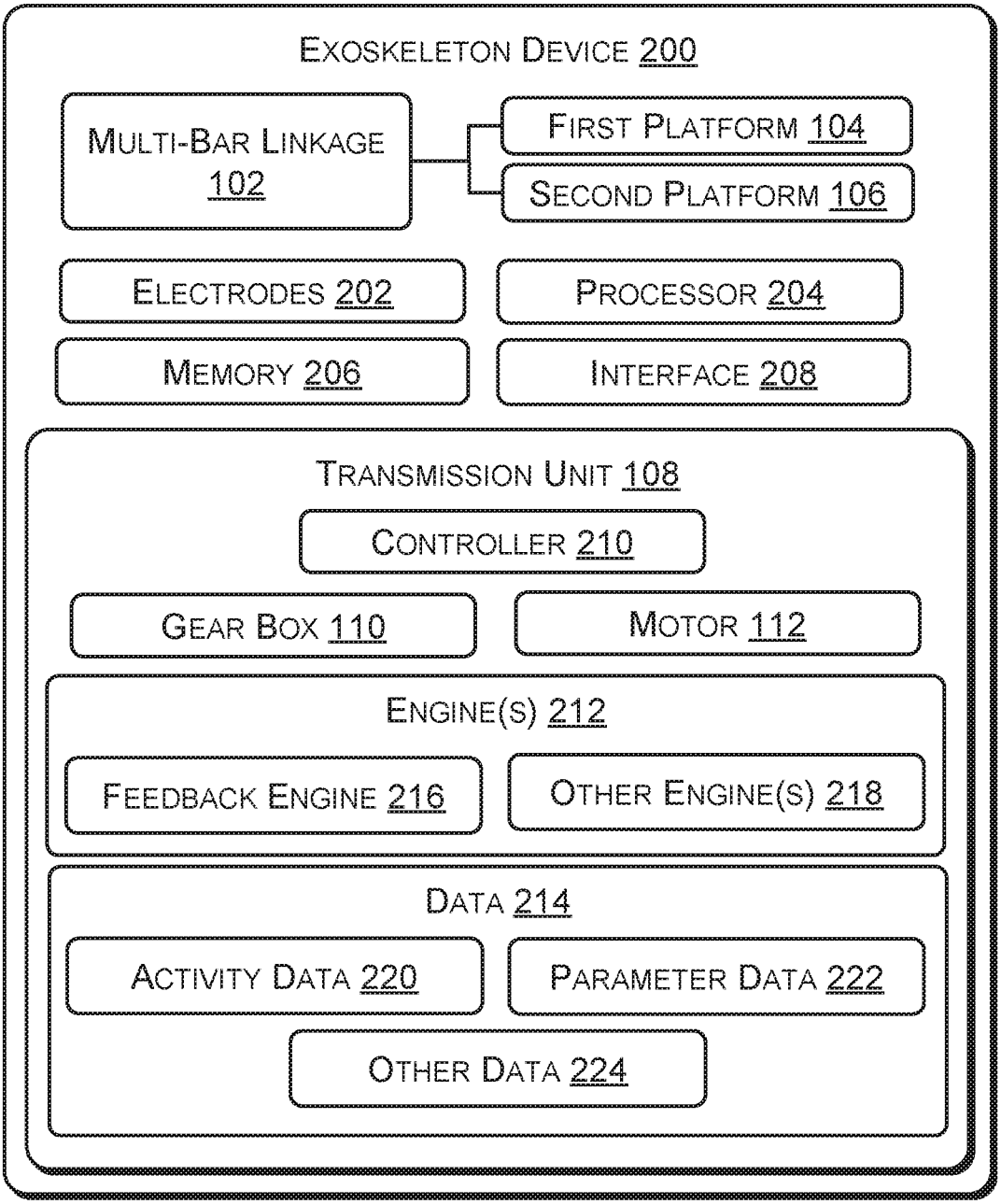
FIG. 2 illustrates a block diagram of the exoskeleton device, according to an example implementation of the present subject matter.

FIG. 2 illustrates a block diagram of an exoskeleton device 200, according to an example implementation of the present subject matter. The exoskeleton device 200 is similar to the exoskeleton device 100, as described with reference to FIG. 1. The exoskeleton device 200 includes the multi-bar linkage 102, the first platform 104, the second platform 106, and the transmission unit 108 having the gear box 110 and the motor 112. Further, the exoskeleton device 200 may include a plurality of electrodes 202. The plurality of electrodes 202 is attachable to a forearm extensor, such as an Extensor Digitorum Communis (EDC) muscle of the patient. The EDC muscle is a muscle of the posterior forearm of the patient and helps in the movement of the distal joints of the upper limb. In an example, the plurality of electrodes 202 detects an activity of the forearm extensor based on an effort applied by the patient.

In one implementation, the exoskeleton device 200 includes a processor(s) 204, memory 206, and interface(s) 208 coupled to the processor(s) 204. The processor(s) 204 may be implemented as one or more microprocessors, microcomputers, microcontrollers, digital signal processors, central processing units, state machines, logic circuitries, and/or any systems that manipulate signals based on operational instructions. Among other capabilities, the processor(s) 204 may be configured to fetch and execute computer-readable instructions stored in the memory 206.

The memory 206 may include any computer-readable medium known in the art including, for example, volatile memory, such as static random-access memory (SRAM), and dynamic random-access memory (DRAM), and/or non-volatile memory, such as read only memory (ROM), erasable programmable ROM, flash memories, hard disks, optical disks, and magnetic tapes. The memory 206 may also store various inputs provided by the patient or a therapist to the exoskeleton device 200 through the interface(s) 208.

Further, the interface(s) 208 may include a variety of software and hardware interfaces, for example, interfaces for peripheral system(s), such as a product board, a mouse, display device, an external memory, and a printer. Additionally, the interface(s) 208 may enable the exoskeleton device 200 to communicate with other systems, such as web servers and external repositories or computers. Using the interface(s) 208, the patient defines the plurality of parameters associated with the movement of the distal joints. Examples of the parameters may include, but are not limited to, an initial angle (first position) of the exoskeleton device 200, a final angle (second position) of the exoskeleton device 200, a time period of detecting activity of the EDC muscle, a speed of movement from the first position to the second position, and an angle of movement. In an example, the plurality of parameters is based on a residual ability of the patient with regard to range of motion of the wrist joint, thereby making the exoskeleton device 200 patient specific.

In an implementation, the transmission unit 108 of the exoskeleton device 200 includes a controller 210 to change the parameters defined by the patient while wearing the exoskeleton device 200. For example, different stroke patients have different symptoms, spasticity, contractures, and synergy patterns. The controller 210 may be connected to a potentiometer knob to provide the flexibility to the patients to control the parameters, such as the speed of the movement, angle of the movement, according to individual patient's capacity. In an example, the controller 210 may be any control mechanism that provides the patient with the flexibility to manipulate the parameters.

Further, the transmission unit 107 includes engine(s) 212 and data 214. The engine(s) 212 include, for example, a feedback engine 216, and other engine(s) 218. The other engine(s) 218 may include programs or coded instructions that supplement applications or functions performed by the transmission unit 108. The data 214 may include activity data 220, parameter data 222, and other data 224. Further, the other data 224, amongst other things, may serve as a repository for storing data, which is processed, received, or generated as a result of the execution of one or more modules in the engine(s) 212.

Although the data 214 is shown internal to the exoskeleton device 200, the data 214 can also be implemented external to the exoskeleton device 200, where the data 214 may be stored within a database communicatively coupled to the exoskeleton device 200. In an example, the data pertaining to the pre-defined parameters are stored as the parameter data 220 and the data, pertaining to the activity of the forearm extensor, detected by the plurality of electrodes 202 is stored as the activity data 222. The activity data 222 may be later utilized for further treatment planning and assessment.

In an implementation, the controller 210 detects the activity of the forearm extensor. Based on the detection, the controller 210 may trigger the motor 112 to activate the multi-bar linkage 102. In an example, the activity of the forearm extensor is detected by an Electromyogram (EMG) using the plurality of electrodes 202. For example, if the patient has defined the time period as 3 seconds to detect the activity, and the patient is able to put in efforts to move the distal joints of the upper limb, for 3 seconds, the controller 210 may trigger the motor 112 to automatically activate the multi-bar linkage 102 to move the upper limb from the first position to the second position and back to the first position. In another example, the activity of the forearm is detected by an Electro-Encephalo-Gram (EEG) device using the plurality of electrodes 202.

Accordingly, the exoskeleton device 200 may be tailored as per individual patient residual ability to make the exoskeleton device 200 patient specific. In an aspect, a threshold may be initially set on the signal detected by the plurality of electrodes 202 by a therapist or the patient or a family member based on an analog value of an activity level of the forearm extensor. For example, the threshold may be set by using the controller 210. In every cycle of say 10 seconds, once the patient achieves the threshold in say 3 seconds, the exoskeleton device 200 is triggered to move the distal joints. For example, the exoskeleton device 200 moves the distal joints from an initial position to a final position and back to the initial position.

In an implementation, the feedback engine 216 is operably coupled to the controller 210 to provide feedback to the patient. In an example, the feedback engine 216 provides feedback with respect to performance of the patient as well as the results obtained. In addition, the feedback engine 216 may provide feedback to the controller 210 regarding a position of the motor 112. The feedback engine 216 may provide feedback regarding the activity of the forearm flexor, such as the EDC muscle. Referring to the above example, if the patient is not able to put in effort for 3 seconds, the plurality of electrodes 202 detect the activity for which the patient is unable to cross a pre-defined threshold, set by the controller 210. In such scenario, the feedback engine 218 provides the feedback of the patient's performance to the controller 210 and the controller 210 guides the patient so that the patient can increase the effort to cross the threshold. In the present implementation, the controller 210 classifies the patients' effort into different levels of thresholds, for example, four thresholds.

In an example, the thresholds may be based on an analog value of amplitude of the muscle activity on the basis of the effort made by the patient. For example, more the effort, more is the threshold achieved by the patient. This is given to the patient in form of feedback through the feedback engine 216. The feedback engine 216 helps the patient to exercise in a more effective manner, thereby ensuring a constant patient engagement and encouragement. In an example, the feedback engine 216 may provide a visual feedback using LED dot matrix.

In operation, the controller 210 receives input from the plurality of electrodes 202 regarding the performance of the patient. Based on the effort of the patient, the controller 210 modifies the threshold that has been set by the patient or the therapist. For example, the controller 210 may increase or decrease the threshold that may be set by the patient or the therapist. Once the controller 210 determines that the patient has met the threshold, the controller 210 may automatically increment the threshold of the activity from say level 1 to level 2 and so on for next cycles. For example, the controller 210 may increment the threshold from 3 millivolts to 5 millivolts. The exoskeleton device 200 therefore constantly encourages and engages the patient. On the other hand, if the threshold of the patient's effort is not attained for certain number of times, the controller may automatically decrement the threshold set by the patient for next cycles.

In an implementation, the exoskeleton device 200 is fail-safe. For example, the exoskeleton device 200 is made in such a way that if the exoskeleton device 200 stops working in between due to any failure, the multi-bar linkage 102 may remain within a pre-defined range of motion i.e. between 0 to 80 degrees. In an example, due to any component failure, if the multi-bar linkage 102 attempts to go out of the pre-defined range, the controller 210 is programmed to automatically stop the exoskeleton device 200. In another example, the gear box 110 is designed such that the gears will lose contact of each other, if the multi-bar linkage 102 goes beyond the pre-defined range, making sure no damage is occurred to the patient. Also, the multi-bar linkage 102 is designed to stop the movement of the exoskeleton device 200 to prevent it from going out of the range.

In another implementation, the exoskeleton device 200 can be operated by the patient as a home-based rehabilitation tool using his unaffected hand. The patient may set the parameters using the interfaces 208. As a result, frequent visits to the hospital may be reduced. In addition, the exoskeleton device 200 is printed on a light weight material using a 3D printing technique, thereby making the exoskeleton device 200 light weight and portable. In an example, the exoskeleton device 200 may be made from an acrylic sheet, a polypropylene sheet, or can be printed using any light weight material.

Figure 3:
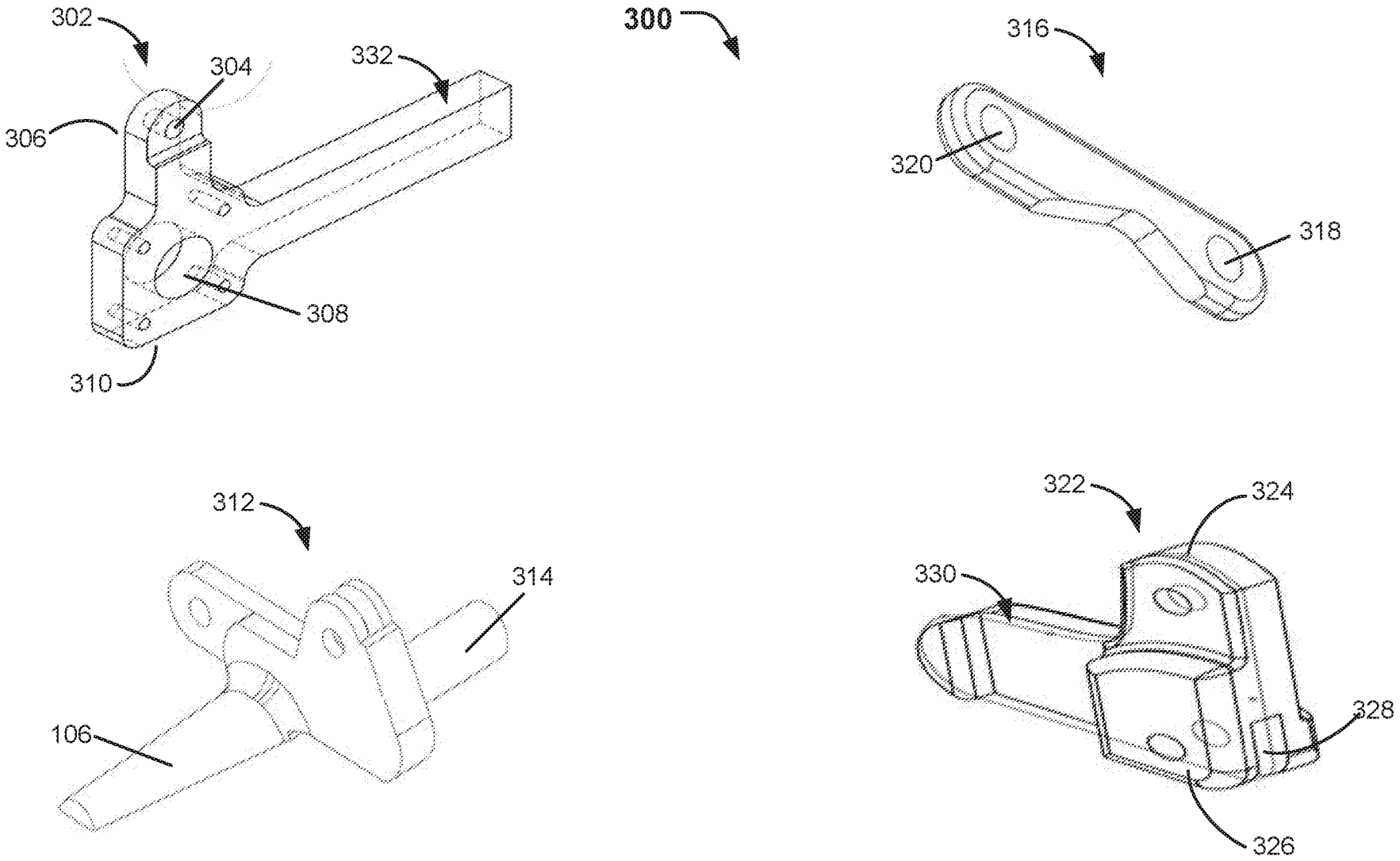
FIG. 3 illustrates an exploded view of a multi-bar linkage of an exoskeleton device, according to an example implementation of the present subject matter.

FIG. 3 illustrates an exploded view a multi-bar linkage 300 of an exoskeleton device, such as the exoskeleton device 100, according to an example implementation of the present subject matter. The multi-bar linkage 300 includes a ground bar 302 having a first opening 304 at a top portion 306 and a second opening 308 at a bottom portion 310. In an example, the ground bar 302 remains fixed at a position. The multi-bar linkage 300 further includes an input bar 312 having an arm 314 extending outwards from the input bar 312 such that the arm 314 is received in the second opening 308 of the ground bar 302. In an example, the second platform 106 extends outwards from the input bar 312 in a direction opposite to the arm 314.

Further, the multi-bar linkage 300 includes an output bar 316 having a first end 318 and a second end 320. The first end 318 of the output bar 316 is coupled with the first opening 304 of the ground bar 302. In addition, the multi-bar linkage 300 includes a floating bar 322 to connect the input bar 312 with the output bar 316 such that a first end 324 of the floating bar 322 is coupled with the second end 320 of the output bar 316 and a second end 326 of the floating bar 322 is coupled with the input bar 312. In an example, the floating bar 322 includes a groove 328 at the second end 326 thereof. The groove 328 is configured to receive one end of the input bar 312 such that the input bar 312 is sandwiched in the floating bar 322 to avoid lateral play along y-axis.

The above-described bars, namely the ground bar 302, the input bar 312, the output bar 316, and the floating bar 322 form a four-bar linkage. The four-bar linkage is the simplest movable closed chain linkage consisting of four bars. The lengths of the four bars decide the degree of motion of the exoskeleton device 100. In an example, the four-bar linkage is of double-rocker type. The mechanical joints of exoskeleton mirrors joints of a hand of a patient.

In an implementation, the multi-bar linkage 300 includes a first axial bar 330 for coupling the first platform (not shown). Further, the multi-bar linkage 300 includes a second axial bar 332 for supporting the forearm of a patient. A joint formed between the input bar 312 and the groove 328 acts as an axis of finger joint. Further, a joint formed between the second axial bar 332 and the input bar 312 acts as an axis of wrist joint for movement in z axis (flexion and extension). In an example, the first platform 104 is attached to the second axial bar 332 with the help of screws. The first platform 104 is adjustable in z axis according to the patient's requirement of degree of finger extension. In an example, the bars of the four-bar linkage are connected to each other with screws.

In an implementation, the bars of the multi-bar linkage 300 are made of a light weight yet strong material, such as Acrylonitrile butadiene styrene (ABS) plastic or aluminum or poly propylene (PP sheet) or acrylic sheet or polycarbonate. In an example, the input bar 312, the second platform 106, and the arm 314 are formed as one solid body.

Figure 4:
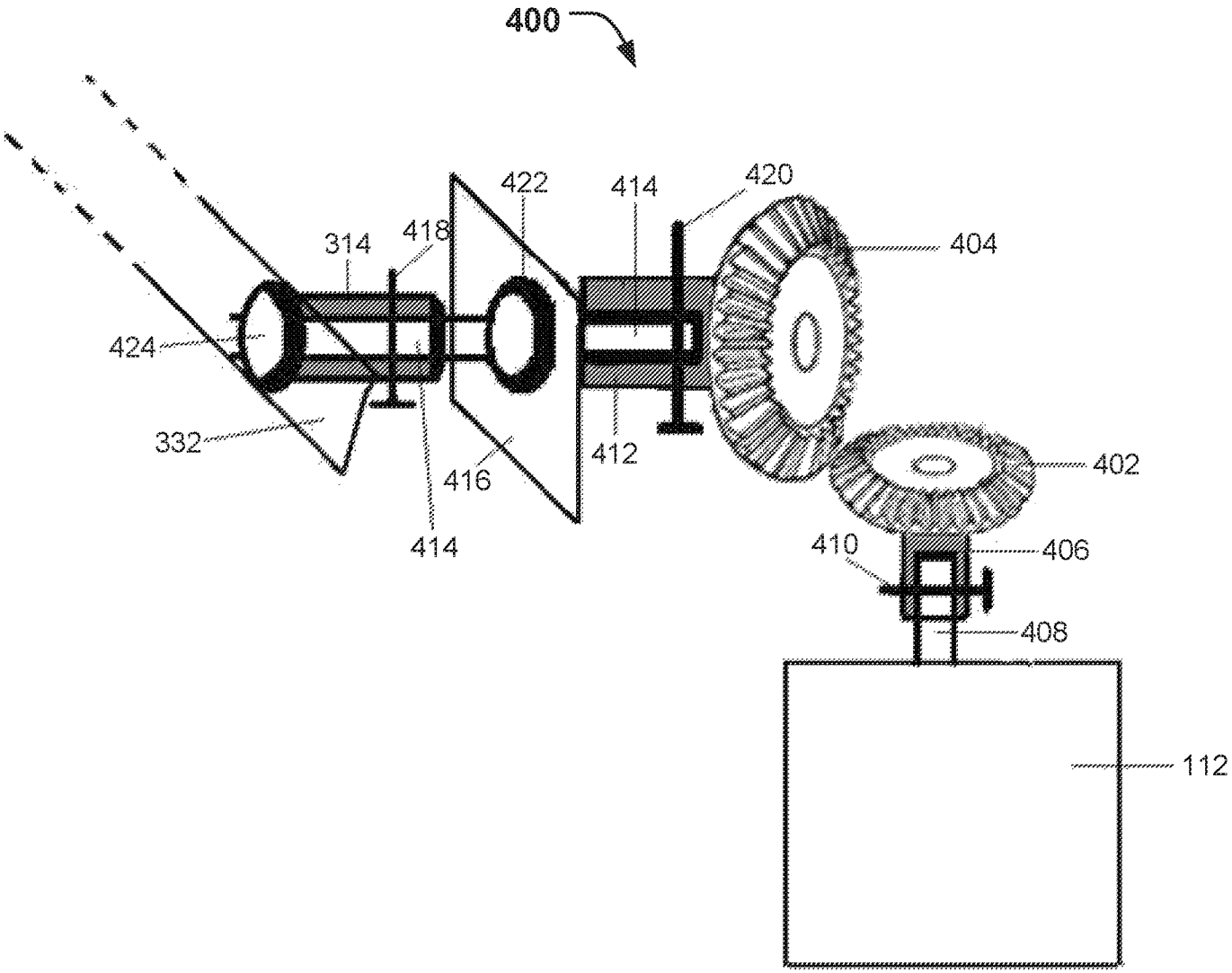
FIG. 4 illustrates a schematic of a gear assembly of an exoskeleton device, according to an example implementation of the present subject matter.

FIG. 4 illustrates a schematic of a gear assembly 400 of an exoskeleton device, such as the exoskeleton device 100, according to an example implementation of the present subject matter. In an example, the gear assembly 400 is within a gear box, such as the gear box 110 of the exoskeleton device. As described with reference to FIG. 1, the gear box 110 is a four-walled box, made up of a light weight material, such as Aluminium, having the gear assembly 400 inside. In the present implementation, the gear assembly 400 includes a first gear 402 and a second gear 404. The first gear 402 with its shaft 406 is connected to the shaft 408 of the motor 112. In an example, the first gear 402 is an input gear and the second gear 404 is an output gear. The shaft 406 of the first gear 402 is connected to the shaft 408 of the motor 112 through a screw 410.

Further, a shaft 412 of the second gear 404 is connected to a hollow cylindrical structure, such as the arm 314 of the input bar (not shown) with a solid cylindrical structure 414 which passes through an assembly plate 416 of gearbox 110. In an example, the solid cylindrical structure 414 is attached to the arm 314 of the input bar and the shaft 412 of the second gear 404 through screws 418 and 420 respectively. In an example, the assembly plate 416 includes a hole having a bearing 422 inside the hole to pass the solid cylindrical structure 414.

In an implementation, the second axial bar 332 of the ground bar 302 includes a hole, such as the hole 308 to accommodate a bearing 424 over the arm 314 to reduce the friction while in motion. Accordingly, an outer diameter of the bearing 424 matches the hole's diameter in the second axial bar 332 and an inner diameter of the bearing 424 matches an outer diameter of the arm 314.

In an example, the first gear 402 and the second gear 404 are of straight bevel type. Further, the first gear 402 and the second gear 404 are perpendicular to each other and have intersecting axes of the shafts 406 and 412 of the first gear 402 and the second gear 404 respectively. The first gear 402 and the second gear 404 includes cone shaped tooth bearing faces. In an example, the teeth of the first gear 402 makes maximum contact with the teeth of the second gear 404 such that the teeth lie on each other. Further, the first gear 402 and the second gear 404 are used, preferably, in 2:1 ratio to half the speed and double the torque of the motor 112.

Figure 5A:
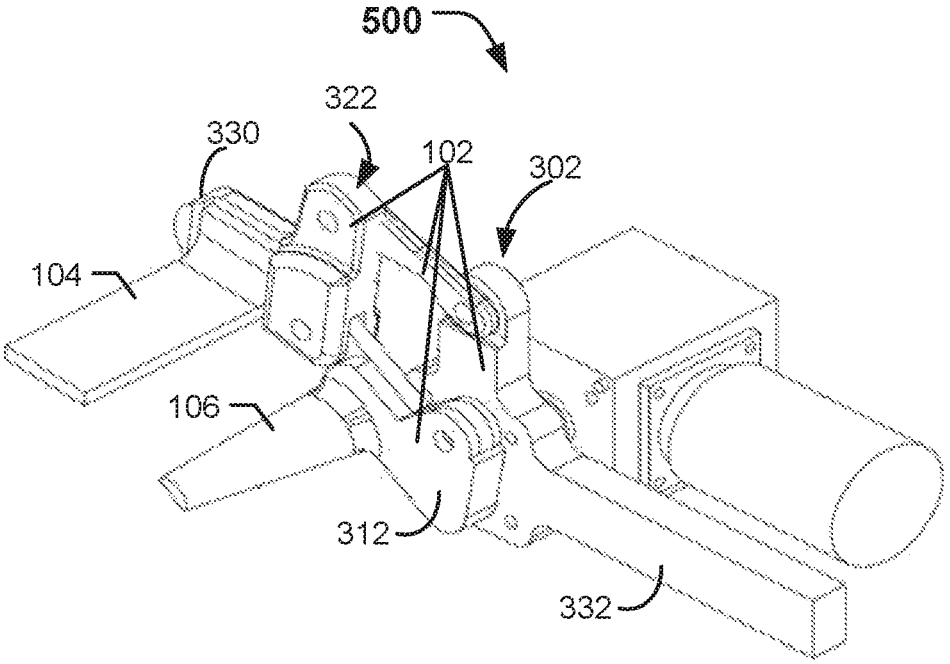
FIGS. 5A-5B illustrate a schematic of an exoskeleton device in first mode, according to example implementations of the present subject matter.
Figure 5B:
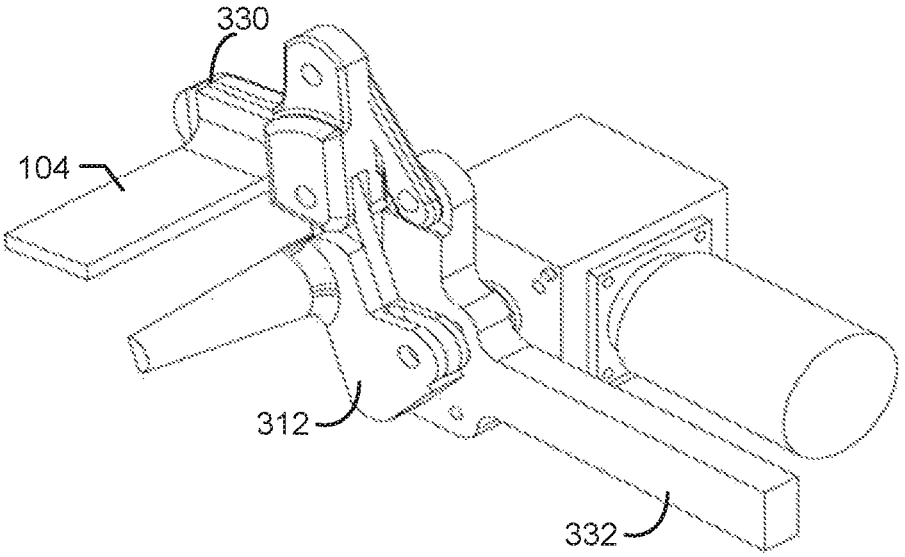

FIGS. 5A-5B illustrates a schematic of an exoskeleton device 500 in a first mode, according to an example implementation of the present subject matter. As described with reference to FIG. 1, the exoskeleton device 500 operates in two modes, namely the first mode and the second mode. In each of the first mode and the second mode, the exoskeleton device 500 moves from a first position to a second position and back to the first position in each cycle as set by the patient. The first position may be understood as a starting position. The first position and the second position may be set by defining an angle at which the distal joints may be positioned initially and an angle by which the distal joints may move.

In the first mode, a first position of the exoskeleton device 500 is depicted in FIG. 5A. In the first position, the input bar 312 lies in straight line with the second axial bar 332 of the ground bar 302 and the first axial bar 330 lies in straight line with a palm of the patient on the second platform 106 and fingers of the patient on the first platform 104, along x-axis. The first platform 104 is connected to the first axial bar 330 of the floating bar 322 through screws and are adjustable in z-axis. In the first position, the wrist is flexed and fingers are extended. Further, the angle between the first axial bar 330 of floating bar 322 and the input bar 312 is not 180 degrees, instead, is maintained at 170 degrees to accommodate maximum finger extension. In an example, the exoskeleton device 500 is designed in such a way that the wrist joint can move between 0 degrees to 80 degrees.

Further, as mentioned with respect to FIG. 1, when the plurality of electrodes (not shown) detect an activity of the muscle of the upper limb for a pre-defined time period, the exoskeleton device 500 automatically activates the multi-bar linkage 102 to move the distal joints from the first position to the second position. In the second position, the input bar 312 moves from 0 degree to 80 degrees in z axis, thereby extending the wrist. In an implementation, the multi-bar linkage 102, stops the input bar 312 from going beyond 80 degrees and below 0 degree in z axis.

As depicted in FIG. 5B, due to the multi-bar linkage 102, as the wrist goes upwards to second position in z axis with the input bar 312, the fingers attached with the first axial bar 330 and supported on the first platform 104, automatically go downward in z axis, leading to finger flexion. Similarly, when moving the distal joints from the second position to the first position, the wrist gets flexed and fingers get extended. In an example, maximum degrees of wrist extension are designed to be 80 degrees in the second position and finger flexion is designed to be 55 degrees for spastic patients.

Figure 6A:
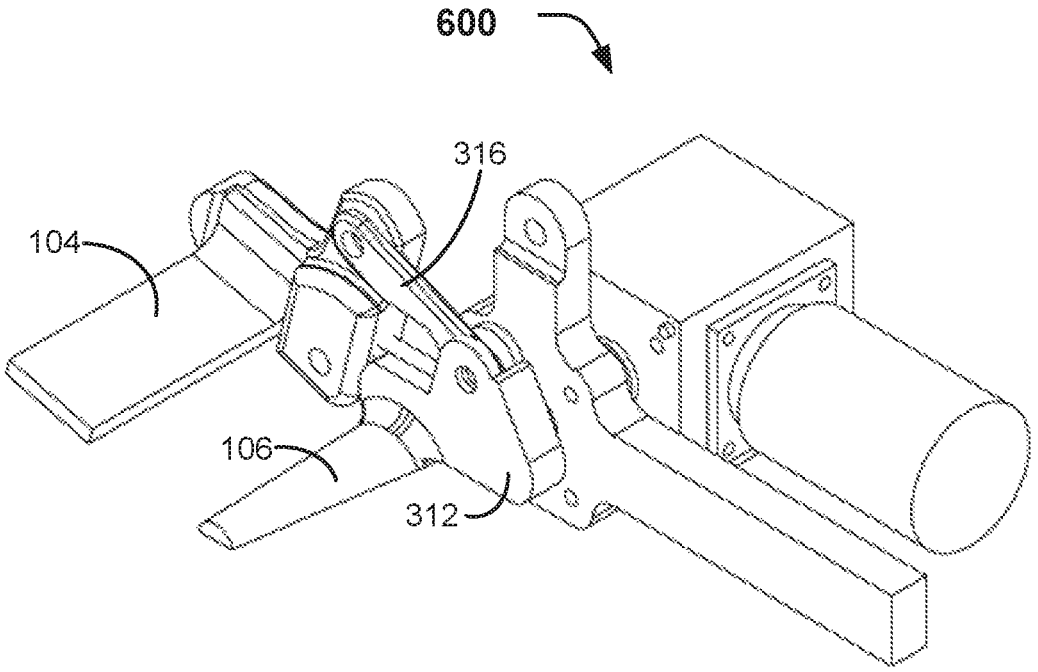
FIGS. 6A-6B illustrate a schematic of an exoskeleton device in a second mode, according to other example implementations of the present subject matter.
Figure 6B:
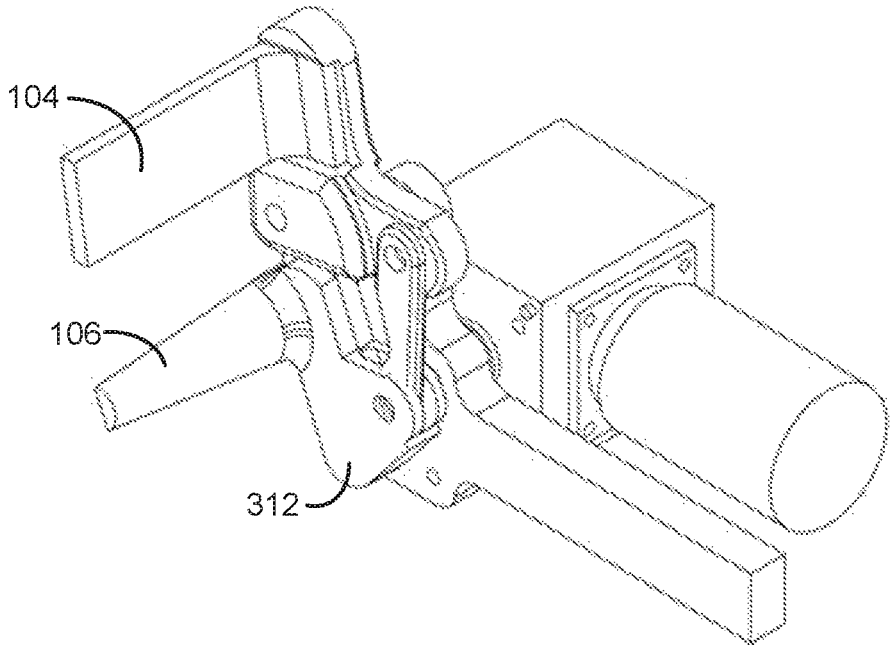

FIGS. 6A-6B illustrates a schematic of an exoskeleton device 600 in a second mode, according to another example implementation of the present subject matter. In the second mode, a first position of the exoskeleton device 600 is depicted in FIG. 6A. In the first position, the input bar 312 is extended in z-axis to accommodate the output bar 316 such that the output bar 316 locks the input bar 312 and the first axial bar 330 in 180 degrees. Accordingly, in the first position of the second mode, the wrist is flexed with the fingers extended with the fingers on the first platform 104 and the palm on the second platform 106.

Further, as depicted in FIG. 6B, the multi-bar linkage 102 moves from 0 degree to 80 degrees in z axis. Therefore, at the second position, the wrist and fingers will be in extension with the fingers on the first platform 104 and the palm on the second platform 106. Similarly, moving from the second position to the first position, the wrist will get flexed and fingers will be extended in the second mode.

Figure 7:
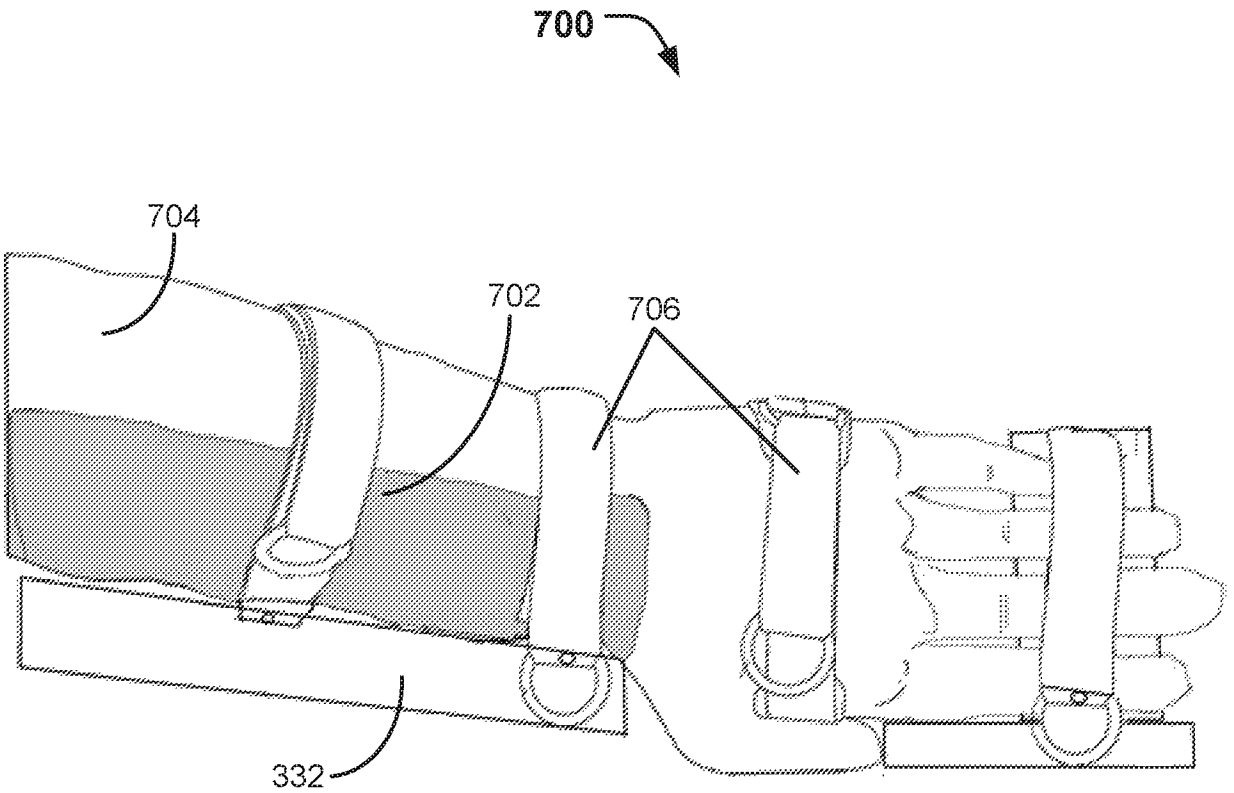
FIG. 7 illustrates a schematic of an exoskeleton device worn by a patient, according to an example implementation of the present subject matter.

FIG. 7 illustrates a schematic 700 of an exoskeleton device, such as the exoskeleton device 100 worn by a patient, according to an example implementation of the present subject matter. In an example, the exoskeleton device includes an armrest 702 for a forearm 704 of the patient. The armrest 702 is made of a light weight yet strong material and is coupled to the second axial bar 332 using screws. The armrest 702 spreads medially from mid-dorsal to full ventral area of the forearm 704 to accommodate the forearm 704 to make the armrest 702 flat to avoid any discomfort to the patient while exercising.

Further, the exoskeleton device includes a fastening mechanism 706 to fasten the forearm 704 of the patient to the armrest 702. In an example, the fastening mechanism 706 includes straps connected to the armrest 702 to wrap around the forearm 704 of the patient. The fastening mechanism 706 may also include a fingers' strap. Though the fastening mechanism 706 is explained as a strap, the fastening mechanism 706 may be any other fastener. In an example, a length of the armrest 702 is almost half of the forearm 704 to accommodate the positioning of the plurality of electrodes (not shown) to monitor the muscle activity. Further, the first platform 104 and the second platform (not shown) is attached with the fastening mechanism 706 to support the palm and fingers of the patient.

In operation, once the exoskeleton device is worn by the patient, the patient or a therapist may connect the exoskeleton device with a power supply. Thereafter, the patient or the therapist defines parameters associated with the movement of the exoskeleton device. For example, the parameters include, speed of motion, initial degree of motion of wrist joint, and final degree of range of motion of the wrist joint. The parameters may be defined based on a capability of the patient or a current activity level of the upper limb of the patient. Upon defining the parameters, the motor (not shown), drives the exoskeleton device and reaches the first position based on which mode is selected by the patient. The patient may then put in effort to move the distal joints. The effort put in by the patient is detected by the plurality of electrodes (not shown) connected to the patient. For example, the plurality of electrodes may detect an activity of the forearm extensor, such as an Extensor Digitorum Communis (EDC) muscle.

In an implementation, the controller (not shown) monitors the activity of the muscle as detected by the plurality of electrodes. If the activity of the muscle is detected for a pre-defined time period, such as 3 seconds, the controller automatically activates the multi-bar linkage (not shown). As a result, the exoskeleton device may cause the distal joints to move from the first position to the second position.

In an example, one complete cycle of exercise with the exoskeleton device is defined for ten seconds. For the first few seconds, say 'x' seconds, the exoskeleton device waits for the patient to reach a preset threshold. In an example, the preset threshold may be a pre-defined analog value or any signal parameter, such as Root Mean Square (RMS) value of muscle signal detected or any biological signal, such as EMG from the muscle which can detect the activity.

Once the threshold has been reached by the patient's voluntary trial within three seconds, the exoskeleton device makes the wrist joint extend with fingers flexed as per the first mode (as depicted in FIGS. 5A-5B). For example, the multi-bar linkage causes the wrist joint to extend with fingers flexed. Further, as per the second mode, due to the locking of the input bar (not shown) and the first axial bar (not shown), the exoskeleton device causes the wrist joint to extend with fingers extended (as depicted in FIGS. 6A-6B).

Further, the transmission unit (not shown) guides the exoskeleton device from the second position to the first position. As the movement of the exoskeleton device from the first position to the second position and back to the first position may take some time, say 'y' seconds, depending on the parameters of speed and range of motion set by the patient. Finally, the remaining time from 10 seconds is computed as delay, say (10−(x+y)), to ensure that each cycle of exercise is for same time duration, i.e., ten seconds. The time duration of the one complete cycle of exercise may be adjusted according to treatment planning of patients.

Although the present subject matter has been described with reference to specific embodiments, this description is not meant to be construed in a limiting sense. Various modifications of the disclosed embodiments, as well as alternate embodiments of the subject matter, will become apparent to persons skilled in the art upon reference to the description of the subject matter.

We claim:

1. An exoskeleton device for rehabilitation of distal joints of an upper limb of a patient, the exoskeleton device comprising:

a multi-bar linkage, wherein the multi-bar linkage comprises:

a ground bar having a first opening at a top portion and a second opening at a bottom portion;

an input bar having an arm extending outwards from the input bar such that the arm is received in the second opening of the ground bar, wherein the second platform extends outwards from the input bar in a direction opposite to the arm;

an output bar having a first end and a second end, wherein the first end of the output bar is coupled with the first opening of the ground bar; and a floating bar to connect the input bar with the output bar such that a first end of the floating bar is coupled with the second end of the output bar and a second end of the floating bar is coupled with the input bar;

a first platform adapted to support fingers of the patient, the first platform being coupled to the multi-bar linkage;

a second platform adapted to support a palm of the patient, the second platform being coupled to the multi-bar linkage; and a transmission unit adapted to drive the multi-bar linkage to move the first platform and the second platform to provide flexion and extension of the distal joints of the upper limb of the patient.

2. The exoskeleton device as claimed in claim 1, wherein the multi-bar linkage is a double-rocker linkage with the floating bar being a shortest link.

3. The exoskeleton device as claimed in claim 1, wherein the floating bar comprises a groove at the second end thereof, and wherein one end of the input bar is received in the groove of the floating bar.

4. The exoskeleton device as claimed in claim 1, wherein:

the second end of the floating bar is connected to one end of the input bar such that a joint formed between the input bar and the second end of the floating bar acts as a finger joint;

the arm extending from the input bar passes through the opening of the ground bar, such that the opening and the arm acts as a wrist joint.

5. The exoskeleton device as claimed in claim 1, comprising:

an armrest adapted to receive a forearm of the patient, the armrest being coupled to a second axial bar from the multi-bar linkage; and a fastening mechanism adapted to fasten the forearm of the patient to the armrest.

6. The exoskeleton device as claimed in claim 5, wherein the armrest is adapted to extend from a mid-dorsal area to a full ventral area of the forearm and adapted to accommodate a forearm of any diameter.

7. The exoskeleton device as claimed in claim 1, wherein the transmission unit comprises a gear box and a motor to drive the multi-bar linkage.

8. The exoskeleton device as claimed in claim 1, comprising a plurality of electrodes attachable to a forearm extensor muscle of the patient to detect an activity of the forearm extensor muscle based on an effort applied by the patient.

9. The exoskeleton device as claimed in claim 8, wherein the transmission unit comprises a controller adapted to activate the multi-bar linkage when the activity of the forearm extensor muscle is detected by the plurality of electrodes for a pre-defined time period.

10. The exoskeleton device as claimed in claim 9, wherein the controller is adapted to control a plurality of parameters associated with movement of the distal joints of the upper limb, and wherein the plurality of parameters comprises at least one of a first position of the distal joints, a second position of the distal joints, a time period of detecting activity of the EDC muscle, a speed of movement from the first position to the second position.

11. The exoskeleton device as claimed in claim 10, wherein the first position is indicative of flexion of the wrist and extension of the fingers.

12. The exoskeleton device as claimed in claim 10, wherein the second position is indicative of extension of the wrist and flexion of the fingers.

13. The exoskeleton device as claimed in claim 10, wherein the second position is indicative of extension of both fingers and wrist.

14. The exoskeleton device as claimed in claim 10, wherein the transmission unit comprises a feedback engine adapted to provide feedback of the activity of the forearm extensor muscle detected by the plurality of electrodes, to the controller.

15. The exoskeleton device as claimed in claim 14, wherein the controller is operably coupled to the feedback engine, the controller is adapted to, receive input from the feedback engine regarding a performance of the patient, based on the input, determine if a plurality of parameters associated with the flexion and the extension of the distal joints of the upper limb of the patient are met for certain number of attempts; and based on the determining, automatically modify a set of the pre-defined parameters associated with flexion and extension of the distal joints of the upper limb of the patient.

16. The exoskeleton device as claimed in claim 9, wherein the controller is programmed to automatically stop the exoskeleton device when the exoskeleton device attempts to go beyond a specified range of motion.

* * * * *